United States Patent [19]

Yanada et al.

[11] Patent Number: 4,558,227

[45] Date of Patent: Dec. 10, 1985

[54] METHOD OF CONTROLLING OPERATION OF THERMOELECTRIC POWER STATION

[75] Inventors: Sadao Yanada; Naganobu Honda, both of Hitachi; Hisanori Miyagaki, Hitachiohta; Seiitsu Nigawara, Hitachi, all of Japan

[73] Assignee: Hitachi, Ltd., Tokyo, Japan

[21] Appl. No.: 618,676

[22] Filed: Jun. 8, 1984

[30] Foreign Application Priority Data

Jun. 14, 1983 [JP] Japan ..... 58-106271

[51] Int. Cl.[4] ..... F01D 19/02

[52] U.S. Cl. ..... 290/40 R; 60/646

[58] Field of Search ..... 290/40 R, 40 C; 60/645, 60/646, 667

[56] References Cited

U.S. PATENT DOCUMENTS

| | | | |
|---|---|---|---|
| 4,053,747 | 10/1977 | Davis | 60/645 X |
| 4,181,840 | 1/1980 | Osborne | 290/40 R |
| 4,228,359 | 10/1980 | Matsumoto et al. | 290/40 R |
| 4,425,762 | 1/1984 | Wakamatsu et al. | 60/646 |

*Primary Examiner*—B. Dobeck
*Assistant Examiner*—W. E. Duncanson, Jr.
*Attorney, Agent, or Firm*—Antonelli, Terry & Wands

[57] ABSTRACT

A method of controlling the operation of a thermoelectric power generating plant, in which the operation of the steam generating equipment and the turbine is controlled in accordance with the plant operation parameters obtained from given patterns of start up and operation of the plant. The method comprises: temporarily setting, in accordance with the above-mentioned patterns, the plant operation parameters concerning the rates of change of state of the plant such as the rates of turbine acceleration and turbine load and rates of increase of the main steam temperature and pressure; estimating the change of the quantity of state of main steam at a designated future moment; estimating the thermal stresses in respective stress-evaluation portions of the boiler and turbine; comparing the estimated thermal stresses with respective allowable thermal stresses determined so as to correspond to the consumption of the life allowed for each start up and operation cycle of the plant; selecting one of the estimated thermal stresses which has smaller margin to the allowable thermal stress and obtaining the operation parameter which provided the maximum rate of change of the state of the plant; repeating these steps until the command state is attained; and controlling the boiler and the turbine in accordance with the thus obtained plant operation parameter.

7 Claims, 10 Drawing Figures

METHOD OF CONTROLLING OPERATION OF THERMOELECTRIC POWER STATION

BACKGROUND OF THE INVENTION

The present invention relates to a method of controlling the operation of a thermoelectric power station and, more particularly, to a method which permits a quick start up of the plant while keeping the thermal stress occurring in the thick-walled part of the plant below a predetermined allowable level.

In recent years, thermoelectric power plants are used for medium levels of load to work in hamonization with nuclear power plants. In these thermoelectric power plants, the operation of the steam generating equipment, as well as the operation of the turbines, is controlled in accordance with plant operating parameters which are obtained from given patterns of start up and operation of the plant. These thermoelectric power plants are required also to respond to the demands for quick start up and stop, as well as demand for drastic change of the load level. It is, therefore, quite important to precisely determine the thermal stresses occurring in the thick-walled parts of the steam generating equipment and turbine, and to control the start up and stopping of the plant, as well as the running of the same, in such a manner as to minimize the consumption of the lives of these parts. When the plant is started up, a specifically large thermal stress occurs in the tube header of the secondary superheater of the steam generating equipment, as well as in the rotor surface and the bore of the turbine rotor adjacent to the labyrinth packing of the first stage.

It is quite difficult to determine the thermal stressed in these parts or to actually measure the temperature distributions around these parts for giving bases to the calculation of the thermal stresses. The measurement of temperature is difficult particularly for the rotor which rotates at a high speed during the operation. In addition, since the condition of the steam varies at every moments, it is almost impossible to accurately determine the thermal stress actually occurring in these parts of the plant. For these reasons, hitherto, it has been a common measure to determine the operation parameters including the starting schedule in accordance with the steam condition before the start up. In this method, however, a large margin is involved accounting for the deviation of the actual steam condition from the planned one. Consequently, unnecessarily long time was taken for the plant to be started up.

In addition, since the control of the steam temperature, which is the factor ruling the thermal stress, suffers from a considerable time lag, it has been materially impossible to conduct a feed-forward control on the basis of the thermal stress.

Under these circumstances, a method has been proposed recently in the specification of U.S. Pat. No. 4,228,359, in which the thermal stresses occurring in various parts of the turbine rotor are estimated and the operation parameters such as acceleration rate, load changing rate and so forth are corrected in view of the estimated thermal stresses. In these methods, the control is made on the basis of the condition of steam generated in the steam generating equipment, and the control of the operation of the plant is made independently of the control of the steam condition in the steam generating equipment. Consequently, the harminization between plants is often failed due to, for instance, a stop of the temperature rise, resulting in an impractically long time for the starting up of the plant.

On the other hand, no practical proposal has been made up to now as to a method in which the boiler is controlled on the basis of thermal stresses estimated to be occurring in the boiler.

SUMMARY OF THE INVENTION

Accordingly, an object of the invention is to provide a method of starting up a thermoelectric plant which permits an efficient use of the life consumption allotted for each start up and operation of the plant, while keeping the thermal stresses in the thick-walled parts in the plant below predetermined allowable levels and minimizing the time length required for the starting up of the plant.

To this end, according to the invention, there is provided a method of controlling the operation of a thermoelectric power generating plant having a steam generating equipment and a turbine, said method comprising: assuming temporarily plant operation parameters concerning the rates of change in various conditions of the plant such as the rate of temperature rise of main steam, rate of acceleration of turbine, rate of change of the load; estimating the change in the quantity of state of the main steam temperature; estimating the thermal stresses in the stress-evaluation portions of the steam generating equipment and turbine on the basis of said parameters; comparing the estimated thermal stresses with the value of the thermal stress determined to correspond to the life consumption allowed for each of the start up and operation cycles; selecting one parameter which provides smaller deviation of the thermal stress from the allowable stress value while affording the maximum rate of change of the state of the plant, i.e., the most quick start up of the plant; and controlling the operation of the steam generating equipment and the turbine in accordance with the thus selected operation parameter.

Figure 7:
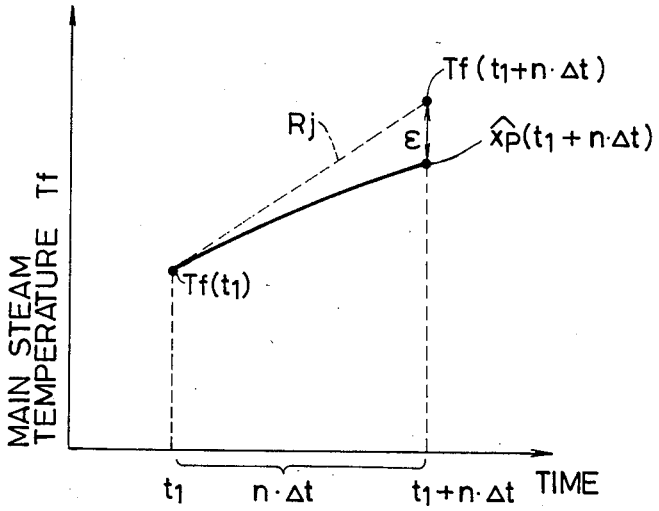
Figure 6A:
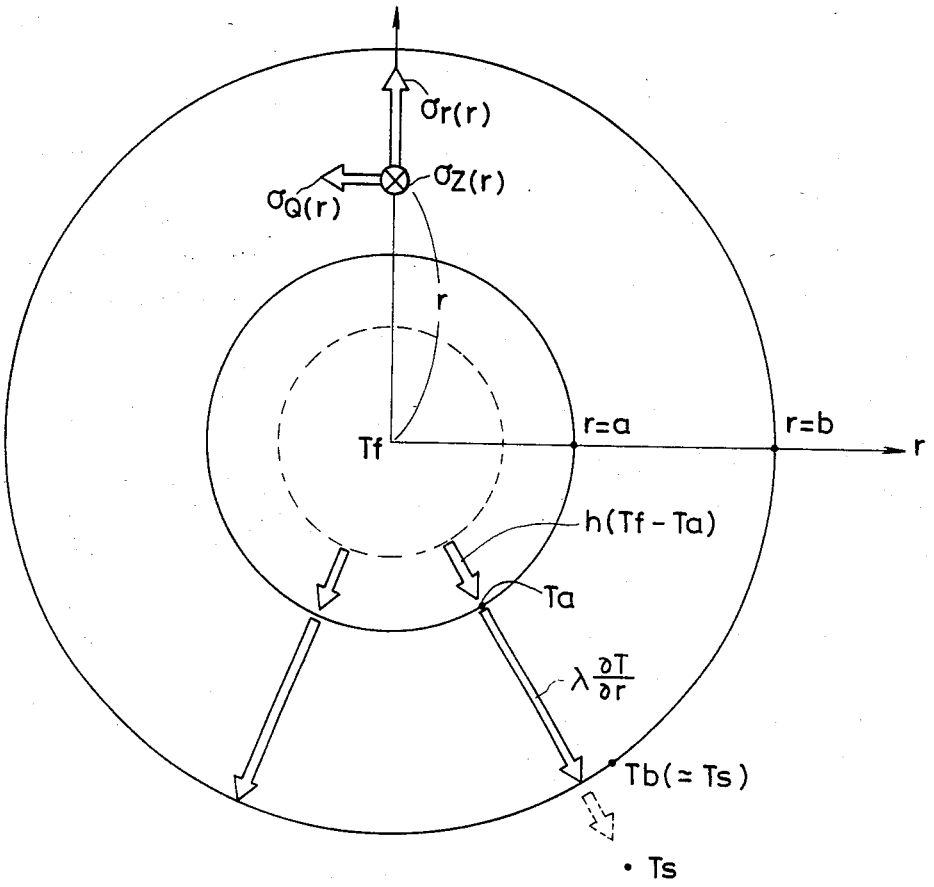
Figure 6B:
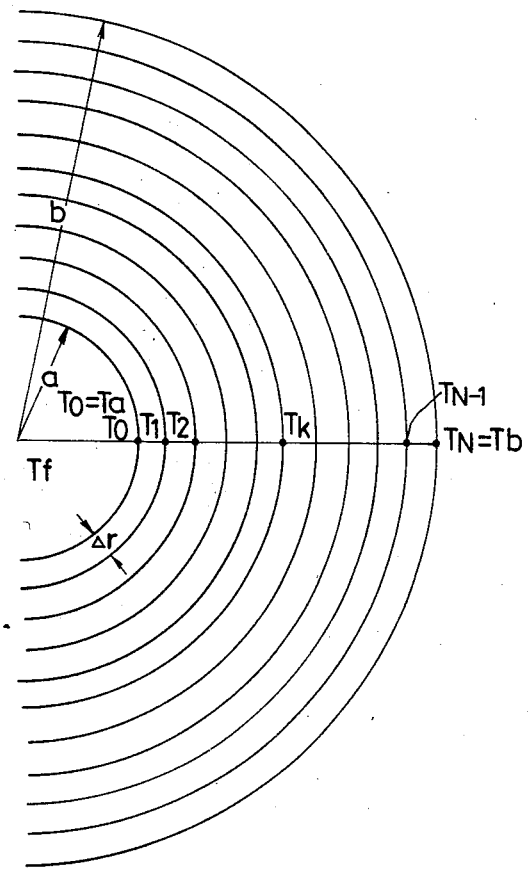
Figure 8:
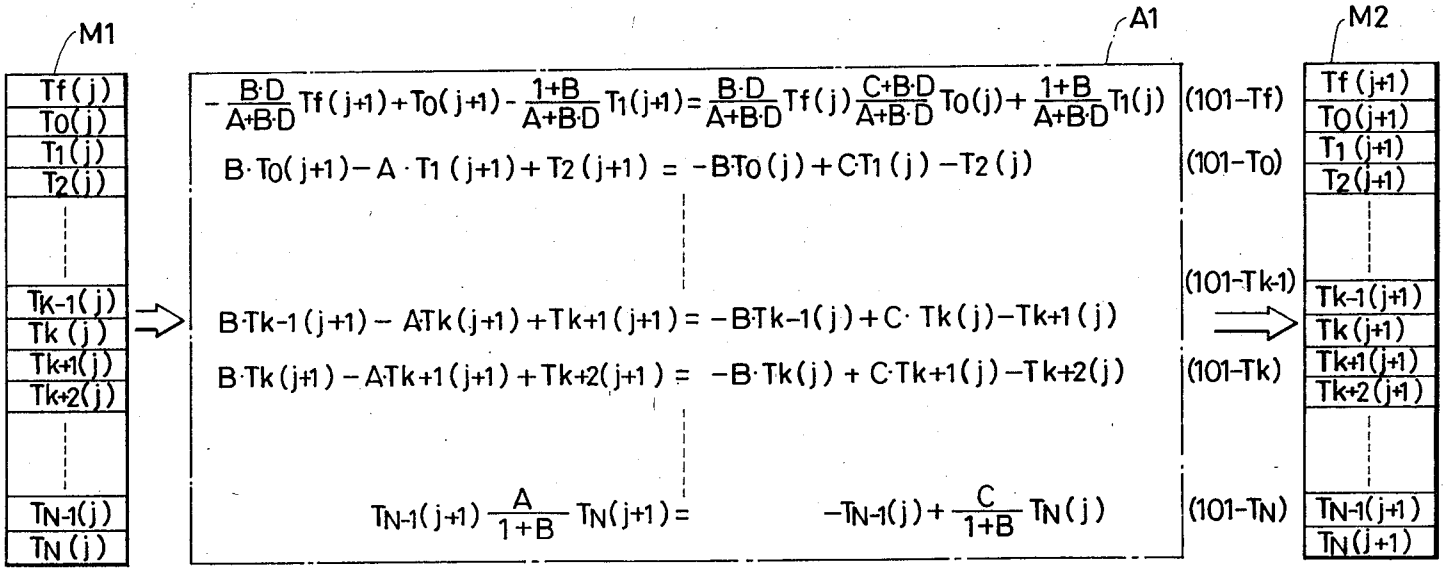
Figure 9:
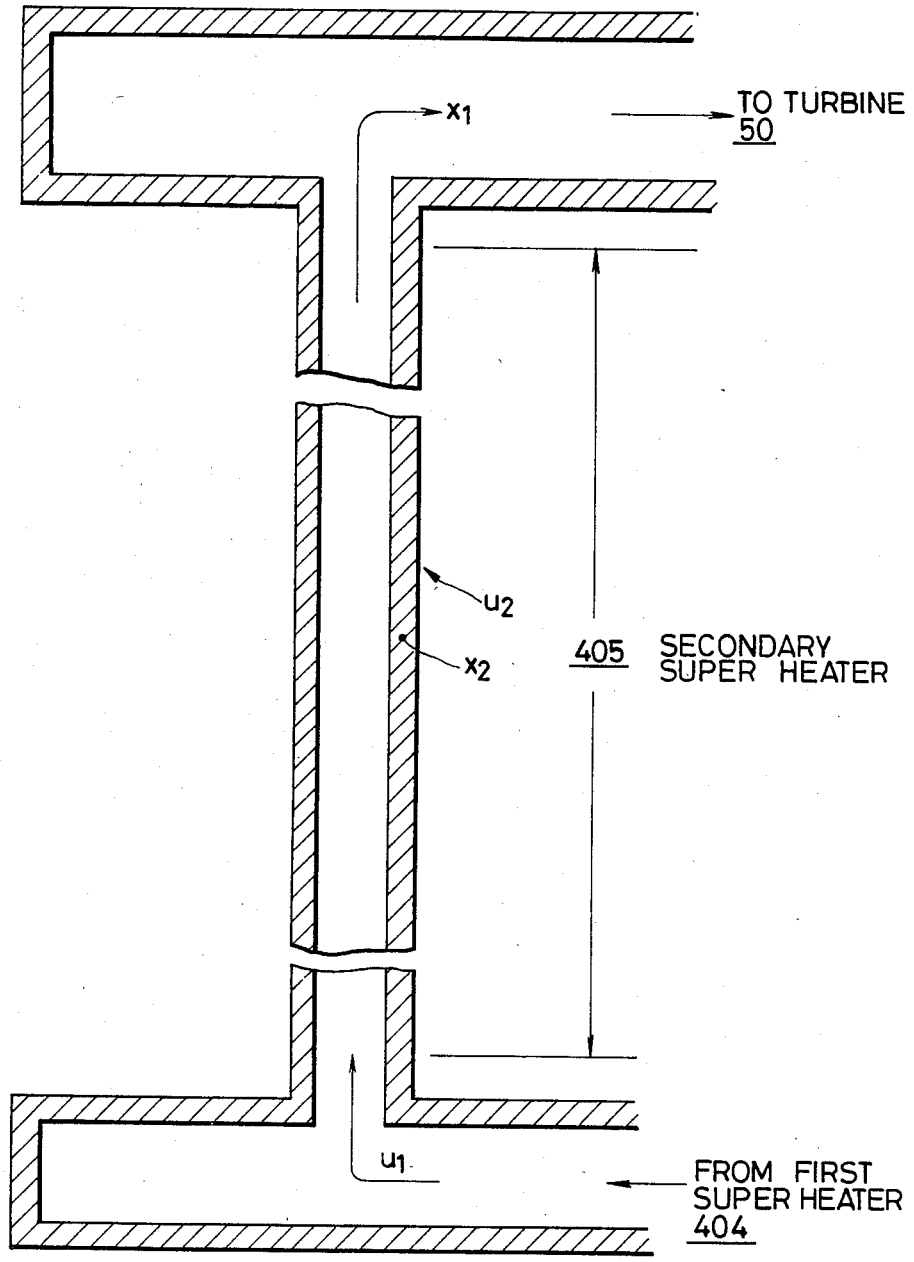

FIGS. **6*a* and 6*b*** are illustrations of the principle of the method for determining the stress in the stress-evaluation point of the boiler, in which:

FIG. **6*a*** is an illustration of the relationship between the heat transmission and thermal stress;

FIG. **6*b*** is an illustration of the method for determining the stress by a difference equation;

FIG. 7 is an illustration of the process for estimating the main steam temperature;

FIG. 8 is an illustration of the process for estimating the temperatures of respective parts of metal by a difference equation, on an assumption that the metal is divided into sections as in the case of FIG. 6*b*; and FIG. 9 is an illustration of the state of heat transfer in a secondary superheater.

DESCRIPTION OF THE PREFERRED EMBODIMENTS

The invention will be described hereinunder with reference to the accompanying drawings showing preferred embodiments of the invention.

Figure 1:
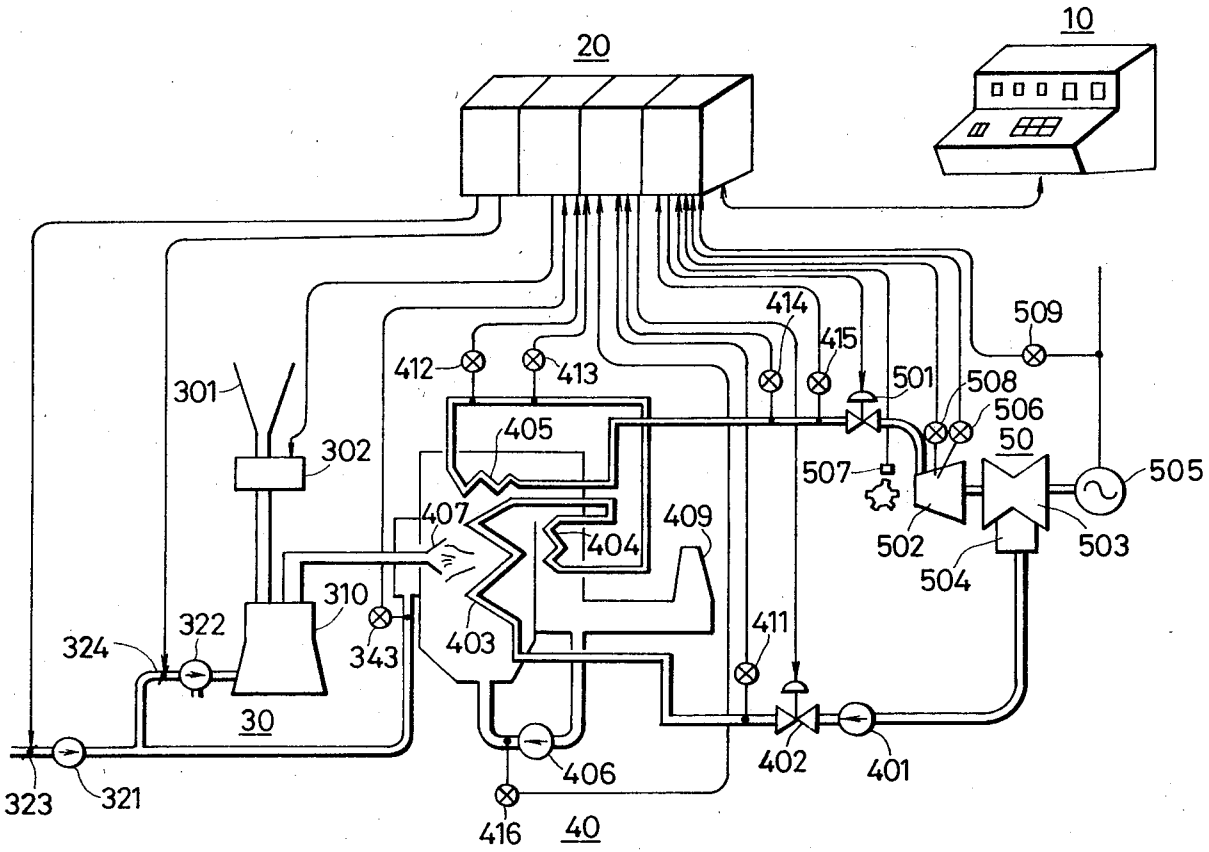
FIG. 1 is a schematic illustration of a thermoelectric power generating plant to which the invention is concerned.

FIG. 1 is a block diagram schematically showing the concept of a thermoelectric power generating plant to which is to be controlled by the method of the invention.

In FIG. 1, a reference numeral 10 denotes a control desk, 20 denotes a digital computer, 30 denotes a coal mill system as an example of the fuel supplying system, 40 denotes a steam generating equipment ((referred to as "boiler system", hereinunder), and 50 denotes a turbine generator system.

In this thermoelectric power generating system, the operator conducts the necessary operation from the control desk 10, in accordance with data on various parts of the plant given through the computer 20, as well as the data delivered by a commanding control station such as a central power supply controlling headquarter. The computer 20 delivers various control signals required for every controlled portions of the plant, upon receipt of data on various parts of the plant and signals derived from the control desk 10.

The coal mill system 30 is constituted by a coal banker 301, coal feeder 302, pulverizer 310, blowers 321,322, and dampers 323,324. The coal is supplied to the mill 310 through the banker 301 and the coal feeder 302, and is pulverized into fine pulverized coal in the mill 310. The pulverized coal is carried away by the air blown by the blower 321,322 to the burner 407 of the boiler system 40 so as to be burnt in the boiler system 40. The computer 20 receives, for the purpose of controlling the coal mill system 30, the flow rate of secondary air by means of, for example, a sensor 343. Furthermore, the computer 20 operates the coal feeder 302 to control the rate of feed of the coal, and operates also a damper 323 for controlling the total air, as well as a damper 324 for controlling the primary air (coal conveying air).

The boiler system 40 has a feedwater pump 401, feedwater control valve 402, evaporator 403, primary superheater 404, secondar superheater 405, chimney 409, gas recirculating blower 406 and the burner 407 mentioned before. The water supplied by the feedwater pump 401 is changed into steam by the evaporator 403, and is changed into superheated main steam as it flows through the primary and secondary superheaters 404,405. The main steam is introduced into the turbine generator system 50. The heat produced by the fuel coal burnt on the burner 407 is utilized in converting the water into steam in the evaporator 403 and also in heating the steam into superheated steam within the superheaters 404,405. A part of the heat, however, is wasted into the air through the chimney 409. Part of the gas emitted from the chimney 409 is returned by the recirculating blower 406 to the boiler so as to be used for the purpose of, for example, diminishing the generation of nitrogen oxides. In order to control the rate of supply of the steam from the boiler, the control valve 402 is controlled by the output of the computer 20. As the data concerning the state of the boiler, feed water supply rate, steam temperature at the inlet to the primary superheater, steam flow rate, main steam temperature, main steam pressure and the recirculated gas flow rate are sensed by respective sensors 411,412,413,414,415 and 416 and sent to the computer 20.

The turbine generator system 50 has a turbine control valve 501, high-pressure turbine 502, medium/low pressure turbine 503, condenser 504 and a generator 505 directly connected to the turbine rotors. In order to control the turbine system 50, the computer 20. In order to control the turbine system 50, the computer 20 receives signals from sensors 506, 507, 508 and 509 which sense the steam pressure behind the first stage of the turbine, turbine speed, steam temperature behind the first stage, and the electric power. The main steam is supplied to the turbines 502 and 503 at flow rates regulated by the control valve 501 which in turn is operated by the output from the computer 20. The steam after expansion through the turbine is cooled and condensed to become condensate in the condenser 504. The condensate is then fed as the feed water to the boiler by means of the feed water pump 401. The electric power sensed by the sensor 509 is delivered to the computer 20.

Various demands concerning the operation of the plant are given to the computer 20 through the control desk 10. In response to these demands, the computer 20 outputs control signals taking into account the data obtained from the plant and the programs which are given beforehand, thereby to control the operation of the plant to achieve the aimed condition. This is the outline of the construction of the thermoelectric power generating plant.

An explanation will be made hereinunder as to the mechanisms of generating thermal stresses in the thermoelectric power generating plant when the plant is being started up.

There are two major points in which large thermal stresses are produced when the thermoelectric power generating plant is started. These points are the portion of the turbine where the labyrinth packing of the first stage is disposed and the tuber header at the outlet side of the secondary superheater of the boiler system 40. An explanation, therefore, will be made as to the process of computation of the thermal stress in the tube header with specific reference to FIG. 2, followed by a description of the process for computing the portion of the turbine facing the labyrinth packing.

Figure 2:
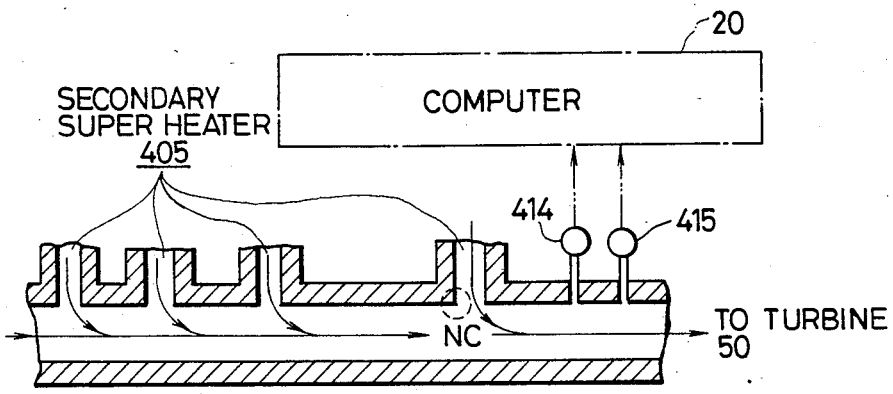
FIG. 2 is an illustration of the tube header at the outlet side of a secondary superheater, used as the stress-evaluation point for evaluating the stress occurring in the boiler.

FIG. 2 is a sectional view of the outlet tube header of the secondary superheater 405 of the boiler system. A plurality of tubes of the secondary superheater merge in one another in this tube header. The tube header is not heated externally but is heated only internally by the internal fluid, i.e., the superheated steam. Since the header has a considerable wall thickness, the header portion experiences a large temperature difference between the inner surface and outer surface thereof, so that a large thermal stress occurs particularly at the nozzle corner portion Nc. In order to estimate the thermal stress Nc occurring in the nozzle corner Nc, the main steam flow rate MSF, main steam temperature MST and the main steam pressure MSP are sensed by sensors 413, 414 and 415.

A discussion will be made first on the temperature distribution along the member. It is assumed here that the tube header at the outlet side of the secondary superheater has the form of infinite cylinder. Then, the temperature distribution along the metal, produced by the heat transfer from the main steam to the tube header member, is given by the following formula (1). In formula (1), the left side member shows the heat transfer from the fluid flowing in the tube to the metal, while the right side member shows the temperature distribution in the metal.

$$\frac{1}{\alpha}\frac{\partial T}{\partial t} = \frac{\partial^2 T}{\partial r^2} + \frac{1}{r}\frac{\partial T}{\partial r} \quad (1)$$

where,

T: metal temperature at moment t at a point of a radius r.

$\alpha$: metal temperature diffusion rate

The following relationships exist between the main steam and the metal inner surface and between the metal outer surface and the exterior of the tube header, as the boundary condition of the header tube.

$$\left.\begin{aligned} -\lambda\frac{\partial T}{\partial r}\Big|_{r=a} &= h\,(T_f - T_a) \\ -\lambda\frac{\partial T}{\partial r}\Big|_{r=b} &= h'\,(T_s - T_b) = 0 \end{aligned}\right\} \quad (2)$$

where, a: inside radius of cylinder b: outside radius of cylinder

Ta: metal temperature at the inner surface of cylinder at moment t

Tf: main steam temperature at moment t

Tb: metal temperature at cylinder outer surface (r=b) at moment t

Ts: metal external temperature at moment t $\lambda$: heat conductivity of metal h: coefficient of heat transfer from main steam to metal h': coefficient of heat transfer from metal to exterior The heat transfer coefficient h is given by the following formula.

$$h = 0.023 Re^{0.8} Pr^{0.4} \cdot \frac{K}{2a} \quad (3)$$

where,

K: heat transfer coefficient of fluid (main steam)

Re: Reynolds number

Pr: Prandtle number

FIG. 6*a* shows the boundary condition (formula(2)) of the heat diffusion system expressed by formula (1). The amount of heat transferred from the steam to the metal inner surface is given by h(Tf−Ta), while the heat conduction in the metal is given by $$-\lambda\frac{\partial T}{\partial r}.$$

The transfer of heat from the metal to the exterior is given by $$-\lambda\frac{\partial T}{\partial r}\Big|_{r} = h'\,(T_s - T_b) = 0.$$

In this Figure, no movement of heat occurs because of the condition of Ts=Tb.

On the basis of the temperature distribution as explained above, the thermal stress at any desired point of radius 6 in FIG. 6*a* is determined by a polar coordinate system as follows. Namely, the radial thermal stress $\sigma_r(r)$, circumferential thermal stress $\sigma_\theta(r)$ and the axial thermal stress $\sigma_z(r)$ are given by the following formulae (4) to (6).

$$\sigma_r = \frac{E\alpha'}{1-\nu}\left\{\frac{1}{b^2-a^2}\left(1-\frac{a^2}{r^2}\right)\int_a^b T(r)rdr - \frac{1}{r^2}\int_a^r T(r)rdr\right\} \quad (4)$$

$$\sigma_\theta(r) = \frac{E\alpha'}{1-\nu}\left\{\frac{1}{b^2-a^2}\left(1+\frac{a^2}{r^2}\right)\int_a^b T(r)rdr - \frac{1}{r^2}\int_a^r T(r)rdr - T(r)\right\} \quad (5)$$

$$\sigma_z(r) = \frac{E\alpha'}{1-\nu}\left\{\frac{2}{b^2-a^2}\int_a^b T(r)rdr - T(r)\right\} \quad (6)$$

where,

E: Young's modulus $\alpha$: coefficient of linear expansion $\nu$: Poisson's ratio (constant)

As stated before, the greatest thermal stress occurs in the nozzle corner Nc of the inner surface. The thermal stress $\sigma$ in this portion is given by the following formula (7) by multiplying the thermal stress of ordinary portion $\sigma_\theta(a)=\sigma_z(a)$ by a stress concentration factor C.

$$\sigma = C\cdot\sigma_\theta(a) \quad (7)$$

$$= \frac{CE\alpha'}{1-\nu}\left\{\frac{2}{b^2-a^2}\int_a^b T(r)rdr - T(a)\right\}$$

It is thus possible to determine the thermal stress in the corner theoretically. The actual computation of this thermal stress is conducted by the computer 20. An explanation will be made hereinunder as to how the computer executes the computation of formula (7) to determine the thermal stress in the corner portion. As will be explained later, one of the features of the invention resides in the determination of a future stress value.

For determining the estimated value of thermal stress (future stress value) at the time of start up of the boiler, it is necessary to determine the future value of the main steam temperature, as will be understood from formula (2) or (7). Therefore, a method for estimating the main steam temperature will be explained hereinunder through a practical example.

The heaviest thermal stress is observed on the inner surface, i.e., the point expressed by r=a in FIG. 6*a*. The stresses in this point are determined by the following formulae (4)',(5)' and (6)' by substituting a for r in the formulae (4),(5) and (6), respectively.

$$\sigma_r(a) = 0 \quad (4)'$$

-continued $$\sigma_\theta(a) = \frac{E\alpha'}{1-\nu}\left\{\frac{2}{b^2-a^2}\int_a^b T(r)rdr - T(a)\right\} \quad (5)'$$

$$\sigma_z(a) = \frac{E\alpha'}{1-\nu}\left\{\frac{2}{b^2-a^2}\int_a^b T(r)rdr - T(a)\right\} \quad (6)'$$

Due to the relationships of $\sigma_r(a)=0$ and $\sigma_\theta(a)=\sigma_z(a)$, the stress value $\sigma_\theta(a)$ is used as the representative value for the evaluation of thermal stress in ordinary portion of the cylinder.

In order to solve the formulae (1) and (2) by a computer, it is necessary to use difference calculus. The cylinder is divided in radial directions into N equal sections (10 sections in the illustrated case). The relationship between the metal temperatures of these sections and the points of division is shown in FIG. 6(*b*), while FIG. 8 illustrates the concept of the difference expansions of formulae (1) and (2) on the basis of the division method shown in FIG. 6(*b*), when the computation is made at a sampling period of $\Delta t$. By solving these simultaneous equations of degree N by n times successively, it is possible to determine the metal temperatures To, $T_1, T_2 \ldots$, Tn at the moment $(t_1+n\cdot\Delta t)$.

In FIG. 8, symbols M1 and M2 represent memories. The memory M1 stores the temperatures To(j) to $T_N(j)$ at respective points of division of metal as shown in FIG. 6(b), as well as the steam temperature Tf(j), while M2 stores the temperatures To(j+1) to $T_N(j+1)$ at respective points of division of the metal after the execution of the equation A1, as well as the steam temperature Tf(j+1). The temperatures To(j+1) to $T_N(j+1)$ and Tf(j+1) are temperatures after the sampling period $\Delta t$ of the computer. The equation A1 is the difference equation expanded from the formulae (1) and (2) for each point of division. For instance, the equation 101-Tf represents the heat transfer on the metal inner surface, while 101-Tk represents the heat transfer at the point k of division. At the next sampling timng, the equation A1 is executed on the basis of To(j+1) to Tn(j+1) and Tf(j+1) to determine Ts(j+2) to $T_N(j+2)$ and Tf(j+2). These values represent the temperature distribution at the moment $2\Delta t$ thereafter. The following relations exist in this Figure.

$$A = \left\{\frac{1}{(\Delta r)^2} + \frac{1}{\alpha\Delta t}\right\} \Big/ \frac{1}{2\Delta r}\left(\frac{1}{\Delta r} + \frac{1}{2r}\right)$$

$$B = \frac{1}{2\Delta r}\left(\frac{1}{\Delta r} - \frac{1}{2r}\right) \Big/ \frac{1}{2\Delta r}\left(\frac{1}{\Delta r} + \frac{1}{2r}\right)$$

$$C = \left\{\frac{1}{(\Delta r)^2} - \frac{1}{\alpha\Delta t}\right\} \Big/ \frac{1}{2\Delta r}\left(\frac{1}{\Delta r} + \frac{1}{2r}\right)$$

$$D = \frac{2h\Delta r}{\lambda}$$

The metal temperatures To($T_1$), $T_1$(t1), . . . , $T_N$(t1) and the temperature Tf(t1) of the internal fluid at the moment t1 are thus determined as shown in FIG. 8. Using these values as the initial values, it is possible to calculate the temperature distribution To(t1+n·Δt), $T_1$(t1+n·Δt), . . . , $T_N$(t1+n·Δt) at the moment n·Δt thereafter, by repeating the calculation by n times.

In the first cycle of computation at the moment $t_0$ at which the computer is started, the distribution is initialized by setting the metal temperatures as $Tf(t_0)=T_0(t_0)=T_1(t_0)= \ldots =T_N(t_0)$. The heat diffusion factor $\alpha$ and the heat conductivity $\lambda$ appearing in FIG. 8 take different values depending on the metal temperatures. Therefore, the volumetric mean temperature Tar of the temperatures $T_0, T_1, \ldots T_N$ at metal dividing points is determined and the diffusion rate $\alpha$ and the heat conductivity $\lambda$ are stored beforehand to permit selection of values thereof corresponding to the volumetric mean temperature Tar. The mean temperature Tar for the first solution of the simultaneous equations shown by the block in FIG. 8 can be determined by using the condition of $Tf(t_0)=T_0(t_0)=T_1(t_0)= \ldots =T_N(t_0)$.

The metal temperature distribution is thus determined by the computer 20 and then the thermal stress is calculated. As stated before, the thermal stress can be determined by the formula (7).

By computing the formula (7) by a digital computer, the following formula (7)′ is used.

$$\sigma = \frac{C\cdot E\alpha'}{1-\nu}\left[\frac{2}{b^2-a^2}\left[T_0\cdot\left\{\left(a+\frac{\Delta r}{2}\right)^2 - a^2\right\} + T_1\cdot\left\{\left(a+\frac{3}{2}\Delta r\right)^2 - \left(a+\frac{\Delta r}{2}\right)^2\right\} + \ldots + T_{N-1}\cdot\left\{\left(a+\frac{2N-1}{2}\cdot\Delta r\right)^2 - \left(a+\frac{2N-3}{2}\cdot\Delta r\right)^2\right\} + T_N\cdot\left\{\left(a+\frac{2N-1}{2}\Delta r\right)^2 - \left(a+\frac{2N-1}{2}\cdot\Delta r\right)^2\right\}\right]\right] \quad (7)'$$

The temperature values of the temperature distribution at the moment $t_1+n\cdot\Delta t$ as determined in relation to FIG. 8 are used as the temperature values $T_1, T_2, \ldots T_N$ in this formula.

In the estimation of the future value of the heat distribution, the steam condition, i.e. the flow rate and the pressure of the internal fluid, can be regarded as being substantially constant. In the start up of the plant, to which the method of the invention is applied, the temperature Tf of the internal fluid is fluctuated so that a large difference may be caused between the actual stress and the estimated stress determined in accordance with the formula (7)′ on the assumption that the internal fluid temperature Tf is constant. It is, therefore, oreferred to estimate the future internal fluid temperature from the present value $Tf(t_1)$. Various measures can be taken for the estimation. For instance, the estimation is conducted by the formula of:

$$Tf(t_1+n\cdot\Delta t) = Tf(t_1) + Rjn\cdot\Delta t$$

where, Rj is the rate of temperature rise as obtained from the temperature change experienced in the past. FIG. 7 shows the internal fluid temperature $Tf(t_1+n\cdot\Delta t)$ as obtained on the basis of this linear estimation. This method, however, still involves a substantial error or difference between the actual internal fluid temperature $\hat{X}p(t_1+n\cdot\Delta t)$ and the estimated temperature. Therefore, an explanation will be made as to the method of estimating the main steam temperature (internal fluid temperature) more precisely.

The method explained hereinunder employs a model of the start-up characteristics of the secondary superheater for the estimation of the main steam temperature. Namely, the main steam temperature $Tf(t+n\cdot\Delta t)$ at the moment $n\cdot\Delta t$ (n being an integer, $\Delta t$ being the computation period), by repeating the computation of the following formulae for n times.

FIG. 9 shows the secondary superheater 405 and the tube header annexed thereto. Representing the main steam temperature at the moment $t_1$ by $x_1$, secondary superheater metal temperature by $x_2$, secondary superheater steam inlet temperature by $u_1$ and the secondary superheater external gas temperature by $u_2$, the start-up characteristics of the secondary superheater can be expressed as follows, using the Law of energy preservation and the heat transfer formula (1), on an assumption that the heat transfer to the secondary superheater is made at a constant pressure, taking into account small fluctuations of the variables in the steady condition of the superheater.

$$\frac{dx_1}{dt} = A_{11}x_1 + A_{12}x_2 + B_{11}u_1 \quad (8)$$

$$\frac{dx_2}{dt} = A_{21}x_1 + A_{22}x_2 + B_{22}u_2 \quad (9)$$

where, $$A_{11} = \frac{-\left\{C_pF_S + A\alpha_{mSR}\left(\frac{F_S}{F_{SP}}\right)^{0.8}\right\}}{V_{rS}C_P} \quad (10)$$

$$A_{12} = \frac{A\alpha_{mSR}\left(\frac{F_S}{F_{SR}}\right)^{0.8}}{V_{rS}C_P} \quad (11)$$

$$A_{21} = \frac{A\alpha_{mSR}\left(\frac{F_S}{F_{SR}}\right)^{0.8}}{M_mC_m} \quad (12)$$

-continued $$A_{22} = \frac{-\left\{A\alpha_{gmR}\left(\frac{F_{gBF}}{F_{gBFR}}\right)^{0.6} + A\alpha_{mSR}\left(\frac{F_S}{F_{SR}}\right)^{0.8}\right\}}{M_mC_m} \quad (13)$$

$$B_{11} = \frac{C_pF_S}{V_{rS}C_P} \quad (14)$$

$$B_{22} = \frac{A\alpha_{gmR}\left(\frac{F_{gBF}}{F_{gBFR}}\right)^{0.6}}{M_mC_m} \quad (15)$$

Assuming here that the values $u_1$ and $u_2$ of the formulae (8) and (9) are held at the same level as those at the moment $t_0$, the following relationships (8)′ and (9)′ are derived.

$$\frac{dx_1}{dt} = A_{11}x_1 + A_{12}x_2 + B_{11}u_1(t_0) \quad (8)'$$

$$\frac{dx_2}{dt} = A_{21}x_1 + A_{22}x_2 + B_{22}u_2(t_0) \quad (9)'$$

These formulae are transformed into the following formula (16) of discrete type for determination of the values $x_1(\Delta t)$ and $x_2(\Delta t)$, after one sampling period $\Delta t$.

$$\begin{bmatrix} x_1(\Delta t) \\ x_2(\Delta t) \end{bmatrix} = \begin{bmatrix} \left(\frac{\mu_1 - A_{22}}{\mu_1 - \mu_2}e^{\mu_1\Delta t} + \frac{A_{22} - \mu_2}{\mu_1 - \mu_2}e^{\mu_2\Delta t}\right) & \left(\frac{A_{12}}{\mu_1 - \mu_2}e^{\mu_1\Delta t} - \frac{A_{12}}{\mu_1 - \mu_2}e^{\mu_2\Delta t}\right) \\ \left(\frac{A_{21}}{\mu_1 - \mu_2}e^{\mu_1\Delta t} + \frac{A_{21}}{\mu_1 - \mu_2}e^{\mu_2\Delta t}\right) & \left(\frac{\mu_1 - A_{11}}{\mu_1 - \mu_2}e^{\mu_1\Delta t} - \frac{A_{11} - \mu_2}{\mu_1 - \mu_2}e^{\mu_2\Delta t}\right) \end{bmatrix} \begin{bmatrix} x_1(O) \\ x_2(O) \end{bmatrix} + \quad (16)$$

$$\begin{bmatrix} \left\{\frac{-A_{22}}{\mu_1 - \mu_2} + \frac{\mu_1 - A_{22}}{\mu_1(\mu_1 - \mu_2)}e^{\mu_1\Delta t} + \frac{A_{22} - \mu_2}{\mu_2(\mu_1 - \mu_2)}e^{\mu_2\Delta t}\right\} & \left\{\frac{A_{12}}{\mu_1\mu_2} + \frac{A_{12}e^{\mu_1\Delta t}}{\mu_1(\mu_1 - \mu_2)} - \frac{A_{12}e^{\mu_2\Delta t}}{\mu_2(\mu_1 - \mu_2)}\right\} \\ \left\{\frac{A_{21}}{\mu_1\mu_2} + \frac{A_{21}e^{\mu_1\Delta t}}{\mu_1(\mu_1 - \mu_2)} - \frac{A_{21}e^{\mu_1\Delta t}}{\mu_2(\mu_1 - \mu_2)}\right\} & \left\{\frac{-A_{11}}{\mu_1\mu_2} + \frac{(\mu_1 - A_{11})e^{\mu_1\Delta t}}{\mu_1(\mu_1 - \mu_2)} + \frac{(A_{11} - \mu_2)e^{\mu_2\Delta t}}{\mu_2(\mu_1 - \mu_2)}\right\} \end{bmatrix} \begin{bmatrix} B_{11}u_1(O) \\ B_{22}u_2(O) \end{bmatrix}$$

where, $$\mu_1 = \frac{(A_{11} + A_{22}) + \sqrt{(A_{11} + A_{22})^2 - 4(A_{11}A_{22} - A_{12}A_{21})}}{2}$$

$$\mu_2 = \frac{(A_{11} + A_{22}) - \sqrt{(A_{11} + A_{22})^2 - 4(A_{11}A_{22} - A_{12}A_{21})}}{2}$$

wherein,

Cp: specific heat at constant pressure of main steam
Fs: flow rate of internal fluid (main steam) in secondary superheater
$E_{SR}$: rated flow rate of internal fluid (main steam) in the secondary superheater
$r_s$: specific gravity of internal fluid (main steam) in secondary superheater
V: volume of internal fluid (main steam) in secondary superheater)
$F_{gBF}$: flow rate of recirculated gas in boiler
$Fg_{BFR}$: rated flow rate of recirculated gas in boiler
Mm: weight of metal of secondary superheater
Cm: specific heat of metal of secondary superheater
A: heat transfer area of secondary superheater $\alpha_{gmR}$: coefficient of heat transfer from steam to metal at rated condition $\alpha_{mSR}$: coefficient of heat transfer from metal to steam at the rated condition It is possible to estimate the temperatures $x_1(n\cdot\Delta t)$ and $x_2(n\cdot\Delta t)$ at the moment $n\cdot\Delta t$, by repeating the computation of the formula (16) for n times, substituting $x_1(0)$, $x_2(0)$ for the values $x_1(\Delta' t)$ and $x_2(\Delta t)$ determined by the formulae (8)' and (9)'.

The formula (16) can be transformed into the following formula (17).

$$X(i)=\phi(-1)\times(-1)+H(i-1)u(i-1) \tag{17}$$

It is assumed here that the progress of the observation of the process is given by the following formula (18).

$$y(i)=c(i)\times(i)+w(i) \tag{18}$$

y(i): observation vector of degree m

C(i): observation matrix of m×n

W(i): observation noise vector of degree m

Therefore, the maximum estimated value X(i) of the signal X(i) can be determined by the following formula (19), using the theory of Karman filter.

$$X(i)=\times(i)+p(i)c(i)w^{-1}\{y(i)-(c(i)\times(i)+w(i))\} \tag{19}$$

where, X represents the estimated amount of the model which is given by the following formula (20).

$$X(i)=\phi(i-1)\times(i-1)+H(i-1)u(i-1) \tag{20}$$

where, $$X(i)=\phi(i-1)X(i-1)+H(i-1)\cdot u(i-1) \tag{20-1}$$

$$p(i)=\{M^{-1}(i)+C^{-1}(i)W^{-1}\cdot C(i)\}^{-1} \tag{20-2}$$

$$M(i)=\phi(i-1)p(i-1)\phi(i-1)+H(i-1)u(i-1)H'(i-1) \tag{20-3}$$

wherein,

X(i): value of n-degree state variable vector at moment i, i.e., $$\begin{pmatrix} X_1(i) \\ X_2(i) \end{pmatrix}$$

(same as X(i) in formula (17))

u(i):

$$r\text{-degree system noise} = \begin{pmatrix} u_1(i) \\ u_2(i) \end{pmatrix}$$

$\phi(i)$: n×n state transition matric

H(i): n×r driving matrix

Thus, according to the invention, it is possible to obtain a highly accurate estimated values, through processing the calculated value X(i) of the main steam temperature by the Karman filter.

The gas temperature $u_2$ of the secondary superheater is given by the following formula (20-4).

$$u_2=\frac{H_u\cdot F_f+H_g\cdot F_a+H_{grf}\cdot F_{grf}-\frac{K}{F_f}\left\{\left(\frac{H_u\cdot F_f}{C_{pg}\cdot F_{gBF}}+273\right)/100\right\}^4}{C_{pg}\cdot F_{gBF}} \tag{20-4}$$

where,

Hu: calorific value of fuel

Ff: flow rate of fuel

Ha: enthalpy of air

Fa: flow rate of air

Hgrf: enthalpy of recirculated gas

Fgrf: flow rate of recirculated gas

Cpg: specific heat of gas

K: constant

The credibility of the value $\tilde{X}(i)$ as provided by the formula (16) can be enhanced by applying the Karman filter.

Therefore, by using the estomated main steam temperature at moment $n\cdot\Delta t$ determined by the formulae (16) and (19) in the calculation of temperature distribution conducted in accordance with the formula (1), and then applying the calculated temperature distribution to the formula (7), it becomes possible to determine the thermal stress at the moment $n\cdot\Delta t$. Needless to say, the main stream temperature may be estimated for a certain period of time thereafter, from the rate of change in the state of the plant set as the plant operation parameter.

Figure 3:
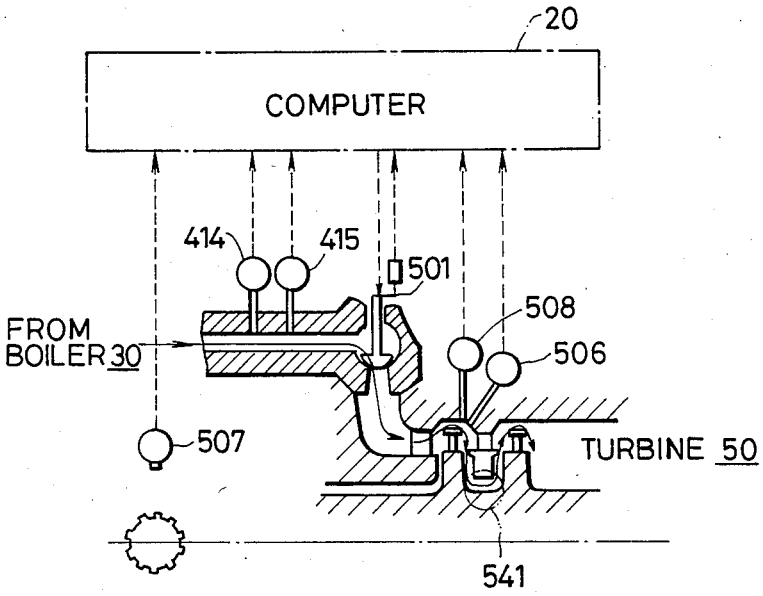
FIG. 3 is an illustration of the steam inlet to the turbine, used as the stress-evaluation point for evaluation of the stress occurring in the turbine.

FIG. 3 is a sectional view of the high-pressure turbine in the turbine generator system 50, particularly the portion 541 adjacent to the labyrinth packing behind the first stage. As stated before, this portion of the turbine experiences the greatest thermal stress. The rotor portion adjacent to this labyrinth packing is subjected to the most severe condition, because the temperature, pressure and velocity of the steam leaking through this packing fluctuate largely when the turbine is started up. Consequently, this portion is subjected to a quick and repetitional heating and cooling and, hence, tends to experience excessive thermal stress. In order to estimate the thermal stress, the main steam temperature, main steam pressure, steam temperature T1st behind the first stage and the steam pressure behind the first stage are sensed by sensors 414, 415, 508 and 506, respectively.

The procedure for calculating the metal temperature distribution or thermal stress of the turbine is detailed in the specification of U.S. Pat. No. 4,228,359. As in the case of the estimation of the temperature distribution and so forth in the boiler, the concept of infinite cylinder is applied also to the computation of temperature distribution in the metal of the turbine. The description, therefore, will be focussed only to the result of the computation. In the estimation of the thermal stress in the turbine, the method described before for estimating the main steam temperature can be used directly in the estimation of the main steam temperature.

As the first step, the temperature distribution of the rotor member will be made.

Assuming here that the rotor metal is an infinite cylinder as is the case of the tube header of the secondary superheater, the temperature distribution of the rotor is given by the formula (1) mentioned before. In this case, however, the symbol $\alpha$ is the heat conductivity of the rotor material, while T represents the temperature in the rotor at a radius r from the rotor axis, at a moment t.

Assuming here that the rotor is divided in the circumferential direction in parallel with the rotor axis into 6 (six) segments, the rotor surface temperature Tf(t'τ) and the rotor bore temperature Tb(t+τ) at the moment thereafter are given by the following formulae (21) and (22).

$$T_f(t+\tau) = \frac{1}{1 + \frac{6\lambda_{fST}\,\overline{r_f}}{K r_f(r_f - r_b)}}(T_{1ST}(t) - T_f(t))T_f(t) \quad (21)$$

$$T_b(t+\tau) = \frac{1}{1 + \frac{r_b}{2r_b}}(T_b(t) - T_b(t)) + T_f(t) \quad (22)$$

where, there are following conditions:

$$\overline{r_f} = \tfrac{1}{2}(r_f + r_2),\ \overline{r_b} = \tfrac{1}{2}(r_b + r_b)$$

$$K = \frac{\lambda_{1ST}\,Nu}{2\delta}$$

wherein,

λ1ST: heat conductivity of steam behind first stage

Nu: Nusselt number

The Nusselt number Nu is given by:

$$Nu = \frac{1}{35.2}\,Re^{0.8} \quad (23)$$

where,

δ: packing clearance $T_{1ST}$: steam temperature behind first stage

The thermal stress $\sigma_f$ in the rotor surface and the thermal stress $\sigma_b$ in the rotor bore, on the basis of the above-shown temperature distribution, are given by the following formulae (24) and (25).

$$\sigma_f(t+n\tau) = \frac{E\alpha'}{1-\nu}(T_{MS}(t+n_f\tau) - T_f(t+n_f\tau)) \quad (24)$$

$$\sigma_b(t+n\tau) = \frac{E\alpha}{1-\nu}(T_{MB}(t+n_b\tau) - T_b(t+n_b\tau)) \quad (25)$$

where, $T_{MS}$: volumetric mean temperature at rotor surface

As will be understood from the foregoing description, it is possible to calculate the thermal stress.

From the foregoing description, it will be clear that the accuracy of the estimation of the steam condition is an important factor for the computation of the thermal stress.

A description will be made hereinunder as to the method of starting the plant, making use of the above-described method of estimation of the thermal stress.

Figure 4:
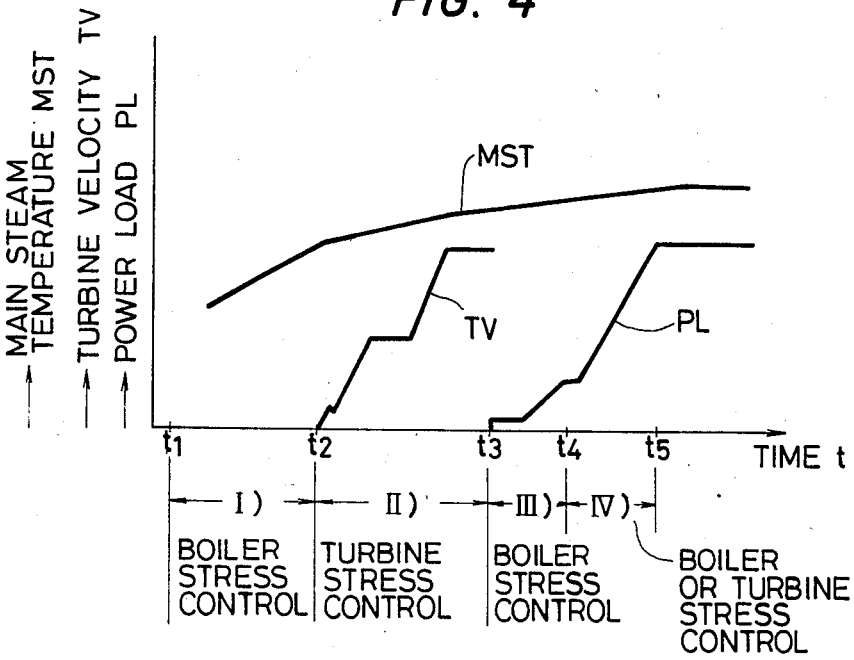
FIG. 4 is a chart showing the process for starting up a thermoelectric power generating plant.

FIG. 4 is a diagram showing the plant start-up characteristics of the thermoelectric power generating plant. in FIG. 4, the axis of abscissa represents the time t, while the axis of ordinate show various values. In this Figure, symbols MST shows the main steam temperature (°C.), TV represents the turbine velocity (RPM), and PL represents the power load (MW). Symbols $t_1$ represents the moment at which the fire is set, $t_2$ represents the moment of commencement of steaming, $t_3$ shows the moment of connection to the electric power line, and $t_4$ shows the moment of change-over of the valves.

(i) Period after moment $t_1$ of setting fire till moment immediately before the steaming ($t_2$) to turbine In this period, steam is not supplied to the turbine 502, so that the thermal stress in the boiler is observed to control the temperature rise and pressure rise in the boiler regardless of the turbine 502.

(ii) Period after steaming ($t_2$) to connection ($t_3$) to electric power line

In this period, various problems such as vibration at critical speed of the turbine are encountered, so that the control is preferably mainly on the basis of the state of the turbine 502. In other words, it is preferred to compute and estimate the thermal stress in the turbine and to accelerate the turbine quickly, selecting the maximum acceleration rate without causing thermal stress in excess of the allowable value. In this period, therefore, it is necessary to increase the temperature and pressure of the steam in the boiler at the rates which are the maximum within the ranges which do not cause a thermal stress in the turbine exceeding the allowable stress.

(iii) Period after connection ($t_3$) to power line to finish of change-over of steam regulating valve In this period, the turbine 502 experiences a comparatively small load change although the boiler temperature is fluctuated largely. In this period, therefore, the maximum rates of increase of the temperature and pressure are selected within the ranges which do not cause thermal stress exceeding the allowable stress in the boiler, and the boiler is controlled on the basis of these selected values. Under these circumstances, the level of the initial load, the rate of load increase from the change-over of the valve to the loading and the level of the load at which the valve is changed-over and the load increase pattern are controlled in such a manner as not to allow the thermal stress in the turbine to exceed the allowable stress.

(iv) Period from moment ($t_4$) at which change-over of valve is completed to application of full load ($t_5$)

In this period, needless to say, it is necessary to minimize the time length for obtaining the rated steam condition, as well as the time length loading the turbine with full load.

In this period, therefore, the control is conducted mainly one of the calculated values of the thermal stress in the boiler and the thermal stress in the turbine, having the smaller margin.

More particularly, for example, when the value of the allowable thermal stress in the turbine is smaller, the the maximum rates of the load change, temperature rise and pressure rise are selected within the range of allowable thermal stress in the turbine, and the turbine is controlled in accordance with the selected rates. On the other hand, the boiler system 40 is controlled in accordance with the rates of change of other states of the plant. In some cases, it is required to increase the load or the steam condition to the rated level in the shortest time. For loading the turbine with the minimum time length, the maximum rate of load increase is selected within the range which does not cause the thermal stress exceeding the allowable level in the turbine. Controlling the loading of the turbine at this rate, the rate of temperature rise and pressure rise of the steam are changed in accordance with the load change.

On the other hand, for minimizing the time length till the rated steam condition is obtained, the maximum rates of increase of steam temperature and pressure are selected within the range which does not cause thermal stress exceeding the allowable stress in the boiler, and the control is made in accordance with the maximum load changing rate selected under such a steam condition.

As explained in (i) to (iv), the thermoelectric power generating plant can be started up within minimum time, safely and with sufficient margin of the thermal stress, in response to the state of operation of the thermoelectric power generating plant.

To sum up, in the operation controlling method of the invention, either one of the maximum rate of start-up of the turbine and the maximum rate of start-up of the boiler, which causes the smaller difference of the thermal stress value from the allowable stress level, is selected and used as the maximum rate of change of state of the plant, and the boiler or the turbine is controlled in accordance with this maximum changing rate of the state of plant.

Figure 5:
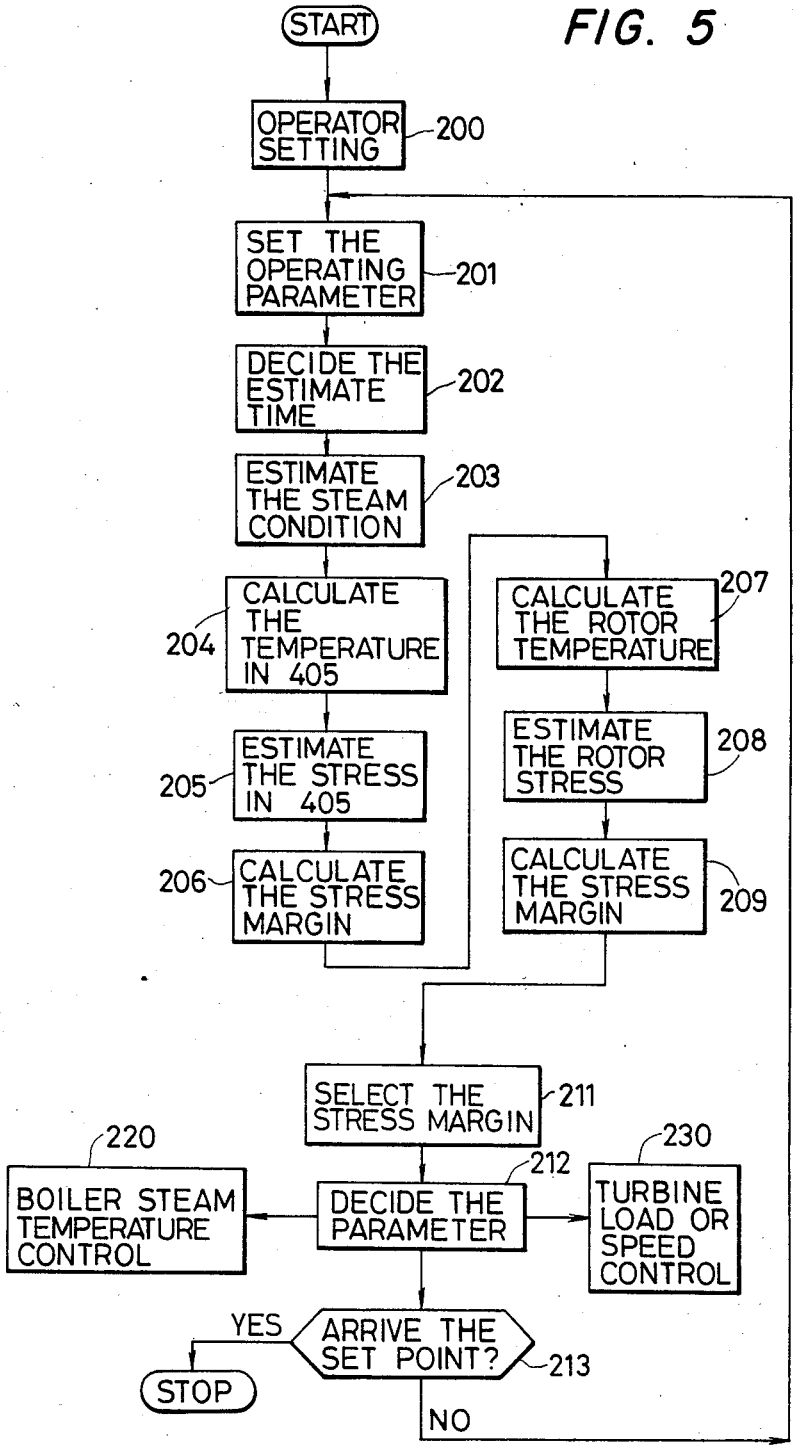
FIG. 5 is a flow chart showing the method of controlling the operation of thermoelectric power generating plant in accordance with the invention.

This operation controlling method will be explained hereinunder with reference to the block diagram as shown in FIG. 5.

For starting up the plant, in a step 200, the operator 1 operates the control desk 10 to set in the operation parameter setting area of the computer 20 various operation parameters such as the plant start-up pattern, operation pattern, allowable thermal stress in boiler (header tube of secondary superheater), allowable thermal stress in the turbine rotor (rotor portion adjacent to labyrinth packing of first stage), and so on. In a step 201, maximum values of the load changing rate and acceleration rate of the turbine 502, as well as the maximum values of the increasing rates of the steam temperature and pressure of the boiler system 40, are determined on the basis of the plant starting-up and operation patterns stored in the predetermined areas of the memory, and are temporarily set in another area of the memory. Then, the process proceeds to a step 202 in which a computation is made to decide the estimate time, i.e., the future moment the thermal stresses at which are to be estimated. The estimation time is decided in accordance with the level of the heat transfer coefficient at the stress evaluation portion such as the portion 504 adjacent to the labyrinth packing, i.e., the state of operation of the plant. In a step 203, computation is made on the basis of the decided estimate time to estimate the steam condition by using, for instance, formulae (16) and (19) explained before. The process then proceeds to a step 204, in which the temperature distribution in the stress evaluation portion (tube header of secondary superheater) of the boiler system 40 is computed. Using the result of this computation, in a next step 205, a computation is conducted to estimate the thermal stress in the tube header of the secondary superheater. Note that this estimation is based on the assumed changing rate mentioned before.

Then, in a step 206, the estimated thermal stress is compared with the allowable thermal stress which was beforehand stored in the setting area of the computer 20 by the operator 1, thereby to determine the margin of the thermal stress. Then, in the steps 207 to 209, in the same way as the steps 204 to 206 explained before, the thermal stress is computed also for the turbine and the margin of the thermal stress in the turbine is stored in a predetermined area of the memory of the computer 20. Subsequently, in a step 211, a judgement is made to identify the period of operation, among the periods (i) to (iv) explained before in connection with FIG. 4. If the present period is the period (i) or (iii), the thermal stress value estimated with the boiler is chosen, whereas, if the present period is the period (ii), the estimated thermal stress value in the turbine is selected. However, when the present period is the period (iv), the priority is given to one of the estimated thermal stress values which has the smaller margin.

The result of the judgement made in the step 211 is given to the step 212. In this step 212, the estimated thermal stress value selected in the step 212 is compared with the allowable thermal stress level which was beforehand set by the operator 1, and a plant operation parameter which can maximize the rate of change of the state of the plant without causing the thermal stress to exceed the allowable stress is selected. In this step, the rate of change of the state of plant, which was temporarily set in the setting area of memory of the computer, is corrected in accordance with the thus selected changing rate of state of the plant.

Then, in a step 212, the temperature rising rate and the pressure increasing rate are inputted to the boiler steam temperature controlling function 220. In a step 212, the acceleration rate and load increasing rate are given to the turbine speed and load control function 230. After making these operations in the step 212, the process proceeds to a step 213 in which a judgement is made as to whether the command value (completion of start-up or operation) has been reached, at each time of setting of the plant state changing rate. If the command has not been reached yet, the process is returned to the step 201. However, if the command is reached in the step 213, the control of the operation is finished.

As has been described, according to the invention, it is possible to control the operations of the boiler and the turbine in harmonization, while keeping the thermal stresses in the turbine and boiler below the levels of the allowable stress. Consequently, according to the invention, it is possible to attain a safe and quick start-up and operation of the plant.

What is claimed is:

1. A method of controlling the operation of a thermoelectric power generating plant having a boiler for generating steam and a steam turbine driven by said steam, for operating the plant within minimum time taking into consideration the thermal stress occurring in the metals of various parts of the plant, the method comprising: estimating the thermal stresses at a future moment in stress-evaluation portions assumed on metal portions of said boiler and said turbine; selecting one of the estimated thermal stresses in accordance with the state of operation of said thermoelectric power generating plant; and controlling the boiler steam temperature or load and speed of the turbine are controlled in accordance with the selected estimated thermal stress.

2. A method of controlling the operation of a thermoelectric power generating plant according to claim 1, wherein said stress-evaluation portion of said boiler is the corner portion of the tube header of the outlet side of a secondary superheater of said boiler.

3. A method of controlling the operation of a thermoelectric power generating plant according to claim 1, wherein said stress-evaluation portion of said turbine is the portion of the turbine rotor adjacent to the labyrinth packing at the steam inlet to the turbine.

4. A method of controlling the operation of a thermoelectric power generating plant according to claim 1, characterized in that the boiler steam temperature is controlled in accordance with the estimated thermal stress in said stress-evaluation portion of said boiler, when the turbine is in the state after setting of fire till steaming to the turbine.

5. A method of controlling the operation of a thermoelectric power generating plant according to claim 1, wherein the turbine speed is controlled in accordance with the estimated thermal stress in the turbine, when the turbine is in the state after the steaming thereto to the application of load.

6. A method of controlling the operation of a thermoelectric power generating plant according to claim 1, characterized in that the boiler steam temperature is controlled in accordance with the estimated stress in the stress-estimation portion of the boiler, when the turbine is in the state after the application of load to the finish of change-over of the steam regulating valve.

7. A method of controlling the operation of a thermoelectric power generating plant according to claim 1, characterized in that the boiler steam temperature or the turbine load is controlled on the basis of one of the estimated thermal stresses in the stress-estimation portions of the boiler and turbine which has the smaller margin to the allowable stress value, when the turbine is in the state after the finish of change-over of the steam regulating valve and the application of full load.

* * * * *